US005090769A

United States Patent [19]

Wade

[11] Patent Number: 5,090,769

[45] Date of Patent: Feb. 25, 1992

[54] CUSHIONED ROCKING CHAIR

[75] Inventor: Guy A. Wade, Santa Clara, Calif.

[73] Assignee: Carolyn L. Lahargoue, Santa Clara, Calif. ; a part interest

[21] Appl. No.: 475,499

[22] Filed: Feb. 6, 1990

[51] Int. Cl.[5] ..... A47C 3/02

[52] U.S. Cl. ..... 297/258; 297/440

[58] Field of Search ..... 297/258, 440, 456, 455, 297/458, 459, DIG. 1

[56] References Cited

U.S. PATENT DOCUMENTS

| | | | |
|---|---|---|---|
| 2,219,624 | 10/1940 | Dixon | 297/258 X |
| 2,783,828 | 3/1957 | Weill | 297/455 X |
| 3,104,132 | 9/1963 | Entwistle | 297/440 |
| 3,526,429 | 9/1970 | Metzge | 297/258 |
| 3,909,064 | 9/1975 | Payne, Jr. et al. | 297/258 X |
| 4,159,146 | 6/1979 | Braconnier et al. | 297/258 |
| 4,201,417 | 5/1980 | Griffith | 297/455 X |
| 4,235,473 | 11/1980 | Aginar | 297/440 |
| 4,278,288 | 7/1981 | Thebaud | 297/258 X |
| 4,819,288 | 4/1989 | Lowthian | 297/DIG. 1 X |

*Primary Examiner*—Jose V. Chen
*Attorney, Agent, or Firm*—Townsend and Townsend

[57] ABSTRACT

A chair includes a pair of spaced inner side walls of plywood or other suitable material. The inner side walls are interconnected by a plurality of cross rods or dowels which pass through the inner side walls and project outwardly from opposed outer surfaces thereof. The outer ends of the rods are received in holes drilled in a pair of outer side walls spaced laterally from respective inner side walls and the outer ends of the rods are bonded to the outer side walls. A tacking strip is applied to the cross rods so that cushions can be placed on the tacking strip. The cushions can be cut from two rectangular blocks of suitable cushion material, such as foam plastic. All of the material can be used from the blocks so that there is no waste of the material. Each outer side wall is spaced outwardly from each inner side wall, respectively, each outer side wall having an upper margin which is complemental to the upper margin of the adjacent inner side wall. Thus, the upper margins of the inner and outer side walls can form armrests which are covered with tacking strips and preferably cushioned strips so as to render the armrests comfortable to the user.

9 Claims, 5 Drawing Sheets

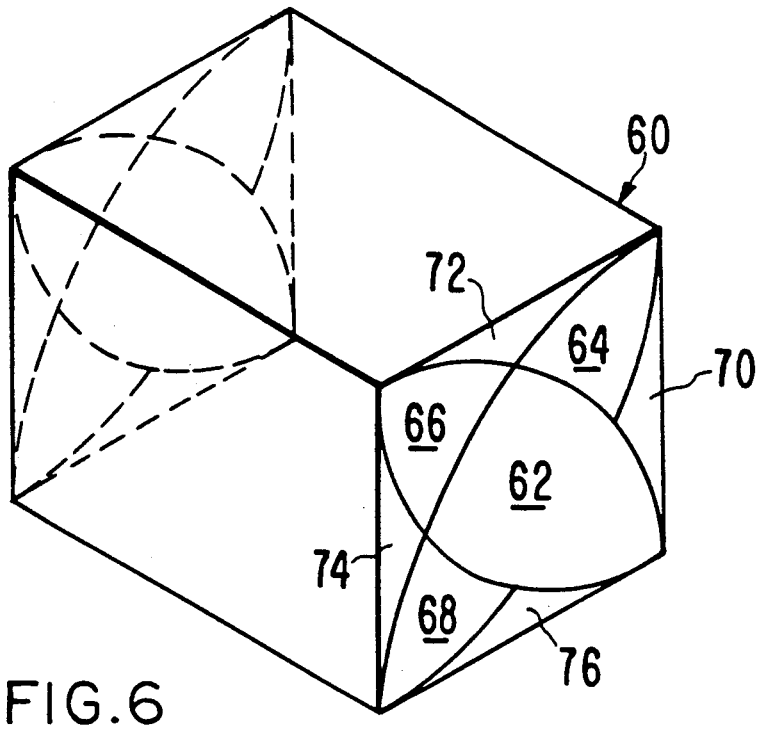
FIG.6
FIG.7
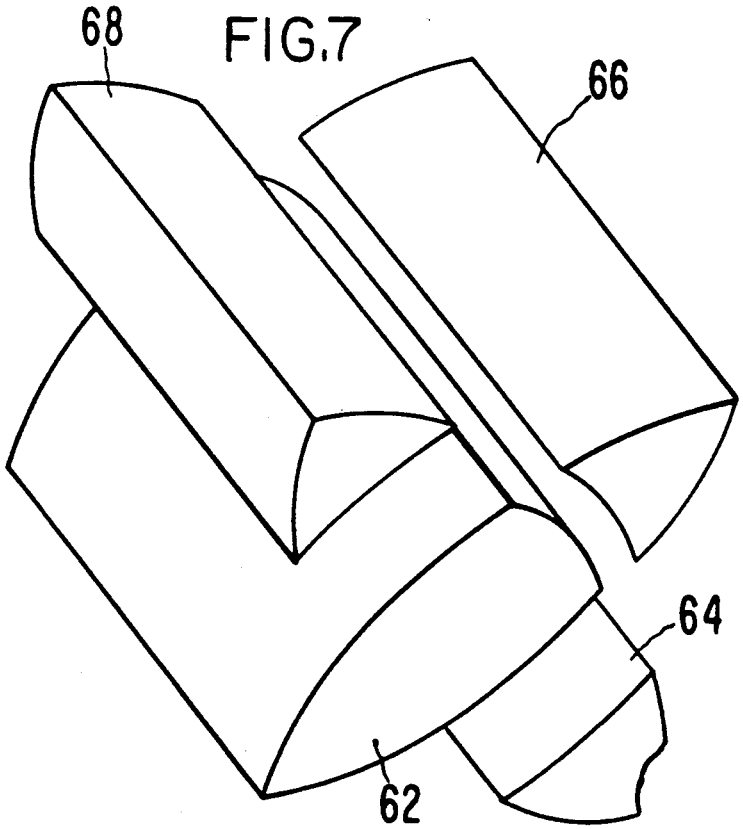

CUSHIONED ROCKING CHAIR

FIELD OF THE INVENTION

This invention relates to improvements in chairs and, more particularly, to a living room chair which is constructed to provide improved comfort and safety to a person sitting in the chair.

BACKGROUND OF THE INVENTION

Chairs for use in the living rooms of homes have been made in accordance with many different designs to provide sitting comfort and safety as well as attractive designs to suit the decor of the location at which the chairs are to be placed. It has always been the desire of many chair designers to make a chair of simple construction which is not only comfortable to the user but is sturdy so as to be safe in use while still being attractive in design.

SUMMARY OF THE INVENTION

The present invention is directed to an improved chair which is both comfortable and safe, yet the chair can be made at a minimum cost and assembled quickly and easily. To this end, the chair of the present invention includes a pair of spaced inner side walls of plywood or other suitable material. The inner side walls are interconnected by a plurality of cross rods or dowels which pass through the inner side walls and project outwardly from opposed outer surfaces thereof. The outer ends of the rods are received in holes drilled in a pair of outer side walls spaced laterally from respective inner side walls. An adhesive bond may be provided to secure the rods to the side walls so that the rods themselves provide the load-bearing structure along with the side walls, the latter having lower convex lower margins, preferably, so that the chair can form a rocking chair.

A tacking strip is applied to the cross rods so that cushions can be placed on the tacking strip and be held in place between the side walls by virtue of a tight fit of the cushions with the inner side walls. The cushions can be cut from two rectangular blocks of suitable cushion material, such as foam plastic. All of the material can be used from the blocks so that there is no waste of the material. The cushions are cut so that the outer surfaces of the cushions effectively mate with adjacent surfaces of the chair against which the cushions are positioned.

Each outer side wall is spaced outwardly from each inner side wall, respectively, each outer side wall having an upper margin which is complemental to the upper margin of the adjacent inner side wall. Thus, the upper margins of the inner and outer side walls can form armrests which are covered with tacking strips and preferably cushioned strips so as to render the armrests comfortable to the user.

The primary object of the present invention is to provide an improved chair which is simple and rugged in construction and is not only comfortable to sit in but is safe and can be made at a minimum cost with a minimum number of parts.

Another object of the present invention is to provide a chair of the type described wherein cushions for the chair are cut from one or more blocks of cushion material in a manner such that all of the material is used to form the cushions to thereby avoid waste material and thereby minimize costs.

Other objects of this invention will become apparent as the following specification progresses, reference being had to the accompanying drawings for an illustration of the invention.

DESCRIPTION OF THE DRAWINGS

FIG. 6 is a perspective view of a block of cushion material showing the lines along which the block is cut to provide cushions for the chair without causing waste of the cushion material;

FIG. 7 is an exploded view of a part of the block of FIG. 6;

DETAILED DESCRIPTION

Figure 1:
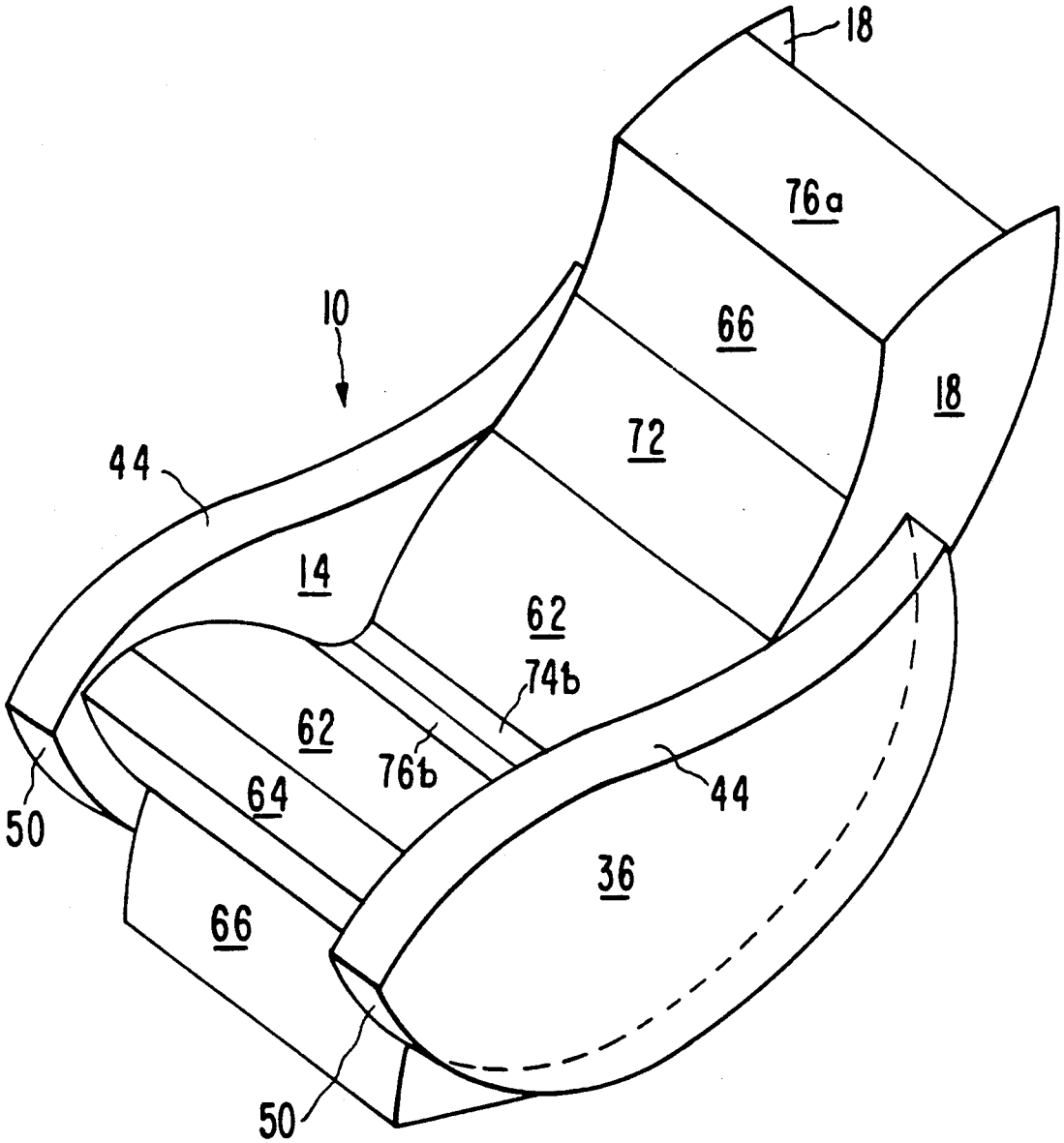
FIG. 1 is a perspective view of the chair of the present invention.

The chair of the present invention is broadly denoted by the numeral 10 and is shown in its completed form in FIG. 1.

Figure 2:
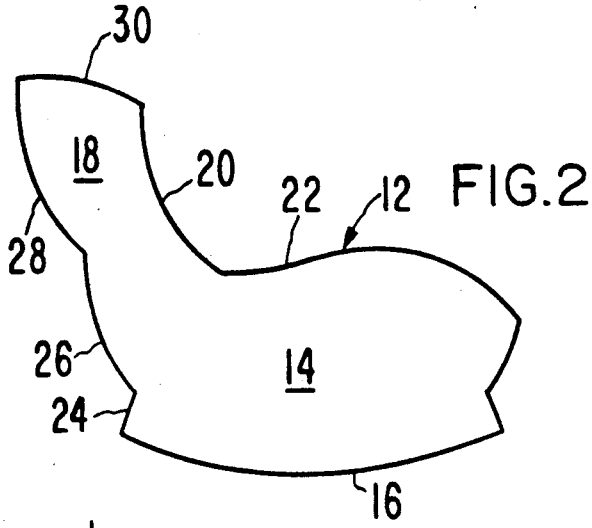
FIG. 2 is a side elevational view of an inner side wall of the chair.
Figure 4:
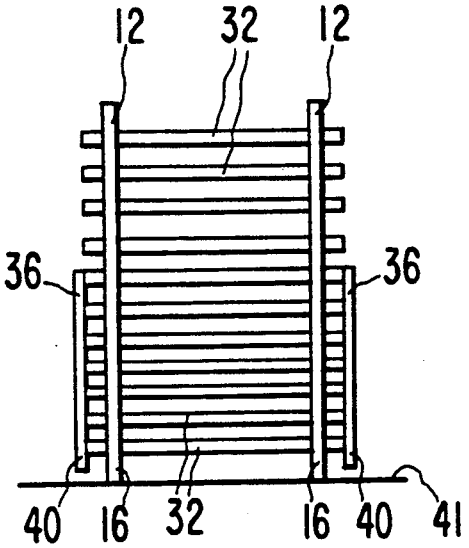
FIG. 4 is a front elevational view of the inner and outer side walls, showing the way in which they are connected by cross rods or dowels.
Figure 5:
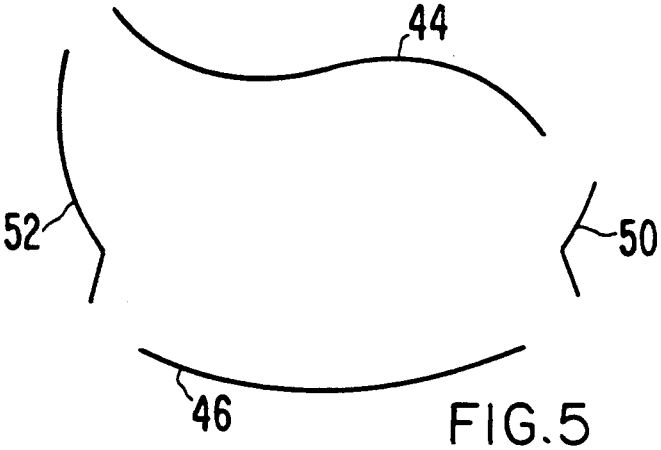
FIG. 5 is a schematic view of the rigid tacking strips placed on the chair to cover open portions of the chair.

Chair 10 includes a pair of inner side walls 12, only one of which is shown in FIG. 2, but the two inner side walls 12 being shown in spaced-apart relationship in FIG. 4. Each inner side wall 12 has a main body 14 provided with a floor-engaging lower margin 16 which is convex as shown in FIG. 1 so that chair 10 can be a rocking chair. Each inner side wall 12 further has an upper rear part 18 which is integral with main body 14 and extends upwardly and rearwardly therefrom to present a concave edge 20 which mates with the upper convex edge 22 of main body 14.

Upper rear part 18 has other margins 30, 28, 24 and 26 as shown in FIG. 1. These various margins define the outer boundary of upper rear part 18.

Inner side walls 12 are interconnected by a plurality of dowels or circular wooden rods 32 which are essentially parallel with each other and span the distance between and extend through inner side walls 12 as shown in FIG. 4. Rods 32 are typically fifteen in number and are anchored in some suitable way, such as by being adhesively bonded to respective inner side walls 12.

Figure 3:
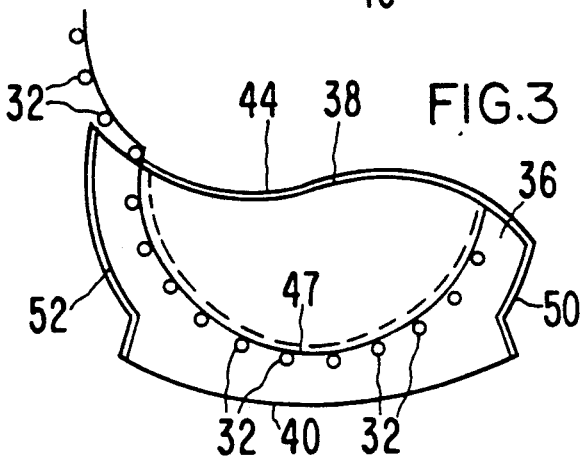
FIG. 3 is a view similar to FIG. 2 but showing an outer side wall of the chair.

A pair of outer side walls 36 are adjacent to and are secured in any suitable manner to respective inner side walls 12 as shown in FIG. 4. Each outer side wall 36 has an upper margin 38 which is essentially the same in configuration as upper margin 22 of body 14 of the adjacent inner side wall 12. The inner side walls 36 have convex lower margins 40 (FIGS. 3 and 4) which are of the same configuration as the lower margins 16 of inner side walls 12, so that margins 16 and 40 can be supported on a floor surface 41 (FIG. 4).

Outer side walls 36 have holes (not shown) which are drilled partially into the inner surfaces of walls 36. These holes receive the ends of adjacent rods 32, and the ends of the rods are adhesively bonded to walls 36 with the walls being spaced from adjacent inner side walls 12 as shown in FIG. 4.

Tacking strips are provided on the chair 10 to cover up openings therein. To this end, a tacking strip 44 is provided to cover the upper portion of the space between the upper margin 22 of each inner side wall 12 and the upper margin 38 of the corresponding outer side wall 36. This tacking strip 44 will effectively close the open space between upper edges 22 and 38.

Likewise, tacking strip 46 is provided to cover the lower portion of the open space between the inner and outer side walls. Tacking strip 47 is also provided and rests on rods 32 and is secured in any suitable manner, such as by tacks (not shown) to inner side walls 12. Similarly, front tacking strips 50 and rear tacking strips 52 are provided on side walls 12 in the manner shown in FIG. 3.

Cushions are provided for chair 10 to render the chair more comfortable in use. The cushions are formed from two rectangular blocks of cushion material, such as foam plastic, one of the blocks being denoted by the numeral 60 and being shown in FIG. 6. The blocks 60 are cut so as to avoid waste of the material. The two blocks used to form the cushions could initially be a single block which is divided in half to form the two blocks. Substantially all of the cushion material of blocks 60 is used when the two blocks are cut into cushion parts in the manner shown in FIG. 6–9 and with the blocks being applied to the chair as shown in FIG. 10.

Figure 8:
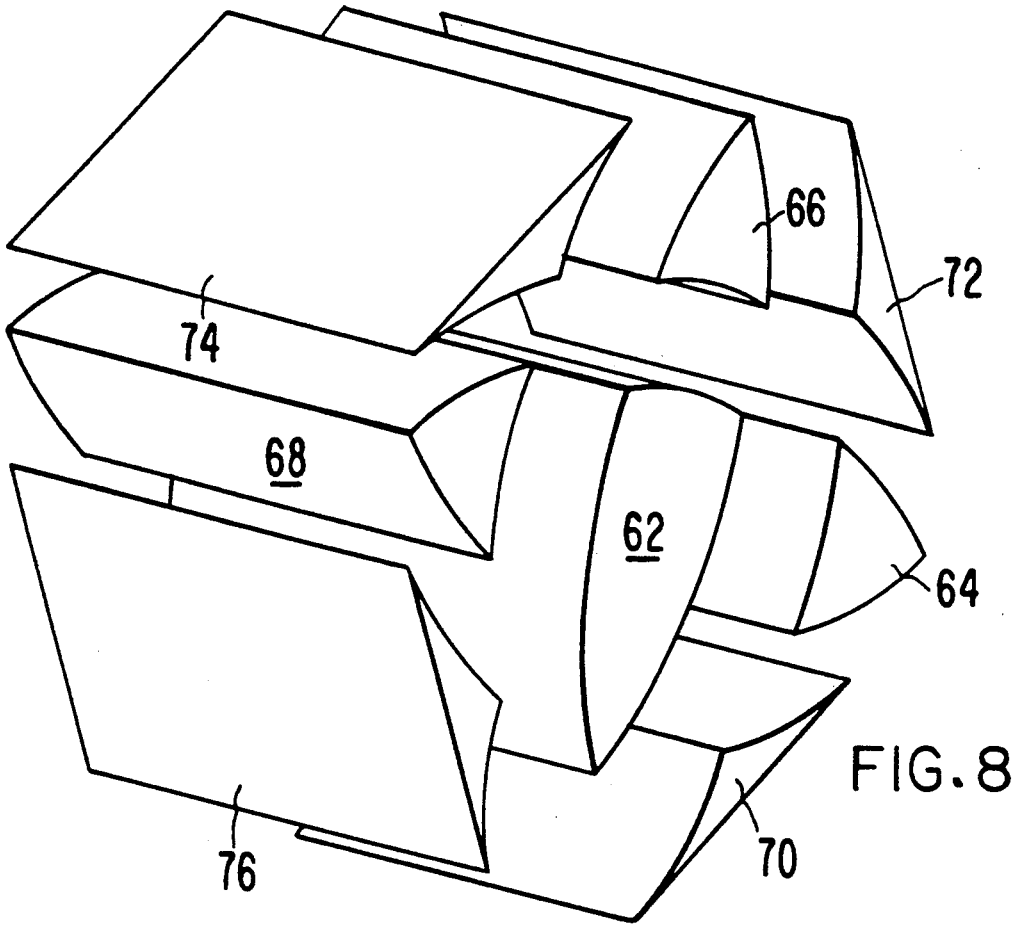
FIG. 8 is an exploded view of the block of FIG. 6.
Figure 9:
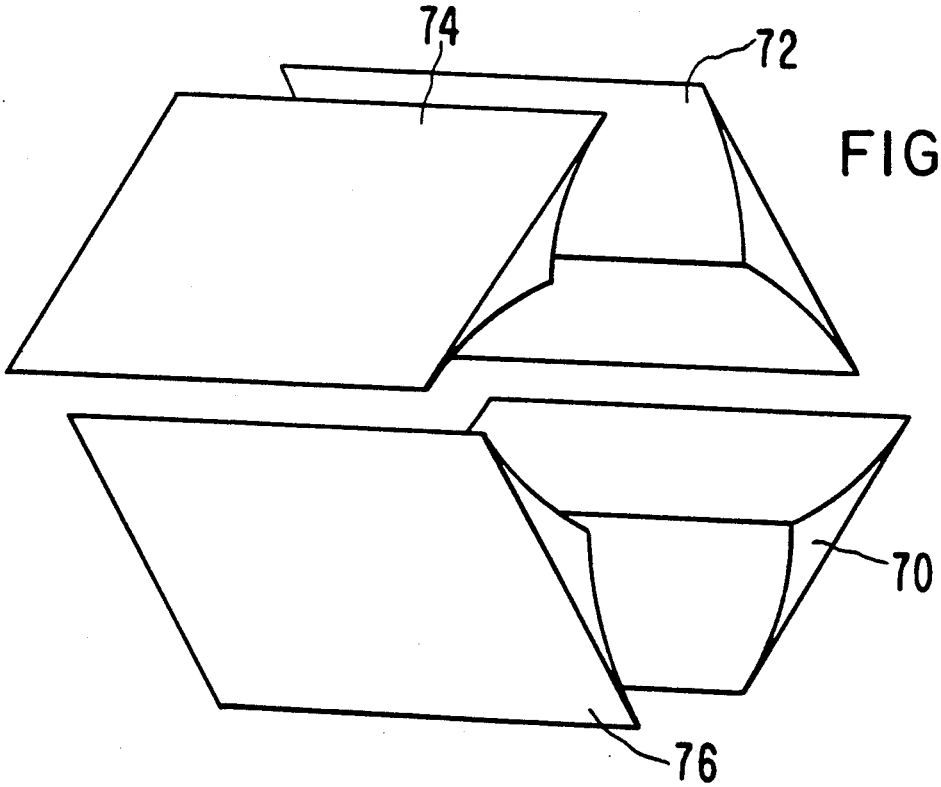
FIG. 9 is an exploded view of a part of the block of FIG. 6.

The first block 60 is cut into parts 62, 64, 66, 68, 70, 72, 74 and 76. Parts 62 and 68 are essentially the same in configuration to each other as are parts 70, 72, 74 and 76. Parts 62–76 are fitted together in the manner shown in FIG. 10 wherein part 62 is shown below part 64 which is coupled to parts 70 and 72, the upper margin of part 72 forming the base for supporting part 66 which in turn supports part 68. Parts 74 and 76 are divided into two pieces so that parts **74*a* and 76*a* are coupled to the top margin of part 68 as shown in FIG. 10. The other halves of parts 74 and 76 are defined as parts 74*b* and 76*b* and are used near the bottom margin of part 62 as shown in FIG. 10. Exploded views of the first block 60 are shown in FIGS. 7–9**.

The second block 60 (not shown) would be cut in the same way as the first block. The second block would yield the following parts as shown in FIG. 10.

Figure 10:
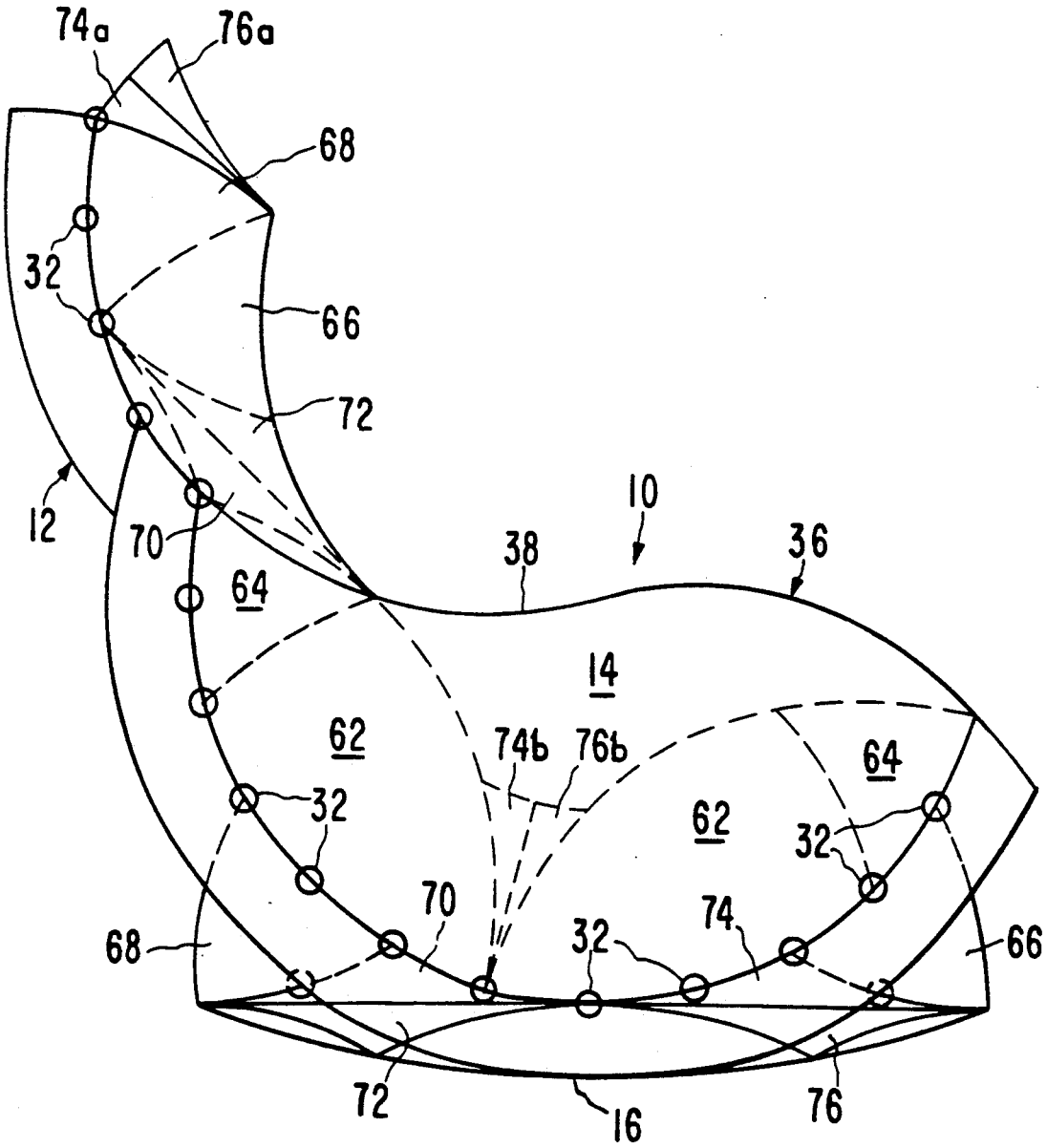
FIG. 10 is a schematic side elevational view of the chair, showing the way in which the parts of the cushion block are fitted together to provide cushions for the chair.

Part 62 would be forwardly of part **76*b*, part 64 would be coupled to the front margin of part 62, part 66 would be near the lower margin of the chair at the front of the chair, part 68 would be near the lower margin of the chair at the rear of the chair as shown in FIG. 10, and parts 70, 72, 74 and 76 would be on the bottom of the chair mating with the lower surfaces of parts 66 and 68 as shown in FIG. 10**.

As outlined above, the length of each block 60 would be to the width of the space between inner side walls 12. The various cushion parts, upon being assembled, would be provided with a suitable adhesive, whereby adjacent parts would bond together and the cushion would form an integral unit. In the alternative, assuming frictional fits between the cushion parts and the inner surfaces of the inner side walls 12, the cushions would be removable, yet would be kept in place on the chair by the frictional forces exerted thereon by the adjacent inner side wall surfaces 12.

I claim:

1. A cushioned rocking chair comprising:

a pair of spaced, inner side walls, each inner side wall having a convex lower marginal edge for engaging a floor in rocking relationship thereto, each inner said wall having an upper marginal edge;

a plurality of spaced, generally parallel rods coupled to and extending through the inner side walls for interconnecting the inner side walls, the rods passing through each inner side wall on a line extending along and adjacent to the lower marginal edge of the inner wall and upwardly toward the upper marginal edge of the inner side wall, the outer ends of the rods being spaced from the respective inner side walls;

means coupled with the rods for securing the rods in fixed positions on respective inner side walls;

an outer side wall adjacent to and spaced outwardly from each inner side wall, respectively, the outer side walls being secured to the adjacent outer ends of the rods, each outer side wall having a convex lower marginal edge for engaging a floor with the lower marginal edge of the adjacent inner side wall in rocking relationship to the floor, each outer side wall having an upper marginal edge extending along and spaced from the upper marginal edge of the adjacent inner side wall;

a number of cushion parts between the inner side walls and supported by the rods; and means covering the spaces between the upper marginal edges of adjacent inner and outer side walls.

2. A chair as set forth in claim 1, wherein is included a tacking strip mounted on the rods, said cushions being supported on the tacking strip.

3. Apparatus as set forth in claim 1, wherein the covering means includes a tacking strip between the upper marginal edges of each inner side wall and the adjacent outer side wall, respectively.

4. A chair as set forth in claim 1, wherein is included a tacking strip means for the space between each inner side wall and the adjacent outer side wall, respectively.

5. A chair as set forth in claim 1, wherein the cushion parts are formed from a pair of identical blocks of cushion material, the cushion parts being cut from the blocks to leave substantially no waste material.

6. A chair as set forth in claim 1, wherein adjacent cushion parts are bonded together.

7. A chair as set forth in claim 1, wherein adjacent cushion parts are separable from each other and are in frictional engagement at the ends thereof with said inner side walls.

8. A chair as set forth in claim 1, wherein each inner side wall has an upper, rear part rigid to and integral with the inner side wall, the line on which the rods pass through each inner side wall extending along said upper, rear part to the upper rear end thereof.

9. A chair as set forth in claim 1, wherein the rods define a seat portion and a back portion, said cushion parts including a seat cushion part and a back cushion part, said seat cushion part and the back cushion part having respective convex outer surfaces.

* * * * *